US008919628B2

(12) United States Patent
Jamlang

(10) Patent No.: US 8,919,628 B2
(45) Date of Patent: Dec. 30, 2014

(54) MODULAR BACKPACK AND A METHOD FOR USING SAME

(76) Inventor: Morris James R. Jamlang, Chicago, IL (US)

( * ) Notice: Subject to any disclaimer, the term of this patent is extended or adjusted under 35 U.S.C. 154(b) by 1498 days.

(21) Appl. No.: 11/985,684

(22) Filed: Nov. 16, 2007

(65) Prior Publication Data

US 2009/0127299 A1 May 21, 2009

(51) Int. Cl.

| | |
|---|---|
| ***A45F 3/04*** | (2006.01) |
| ***A45F 3/10*** | (2006.01) |
| ***A45F 3/14*** | (2006.01) |
| ***A45F 4/02*** | (2006.01) |
| *A45C 7/00* | (2006.01) |

(52) U.S. Cl.

CPC ... *A45F 3/10* (2013.01); *A45F 3/14* (2013.01); *A45F 4/02* (2013.01); *A45C 7/0086* (2013.01); *A45C 7/009* (2013.01)

USPC ..... 224/583; 224/627; 224/637; 224/153

(58) Field of Classification Search

CPC ..... A45F 3/04; A45F 5/14; A45C 7/0086; A45C 7/0045

USPC ..... 224/153, 627, 628, 637, 645, 651, 653, 224/578, 579, 581–583; 190/108; D3/216, D3/217

See application file for complete search history.

(56) References Cited

U.S. PATENT DOCUMENTS

| | | | | | |
|---|---|---|---|---|---|
| 3,114,486 | A | * | 12/1963 | Flexman | 224/628 |
| 4,236,657 | A | | 12/1980 | Brunton | |
| 4,424,841 | A | * | 1/1984 | Smith | 224/240 |
| 4,883,207 | A | | 11/1989 | McArthur | |
| 4,884,731 | A | | 12/1989 | Sibley | |
| 4,961,522 | A | | 10/1990 | Weber | |
| D346,693 | S | | 5/1994 | Saltzman et al. | |
| 5,402,869 | A | | 4/1995 | Saltzman et al. | |
| 5,544,792 | A | * | 8/1996 | Arnwine | 224/153 |
| 5,628,443 | A | * | 5/1997 | Deutsch | 224/583 |
| 5,724,707 | A | * | 3/1998 | Kirk et al. | 24/3.7 |
| 5,964,384 | A | | 10/1999 | Young | |
| 6,189,750 | B1 | | 2/2001 | Von Neumann | |
| 6,216,926 | B1 | * | 4/2001 | Pratt | 224/153 |
| 6,230,771 | B1 | | 5/2001 | Hellenbrand | |
| D500,590 | S | | 1/2005 | Sachen | |
| 7,124,921 | B1 | | 10/2006 | Hubbell | |
| 2004/0007605 | A1 | * | 1/2004 | Mares | 224/630 |
| 2006/0208024 | A1 | * | 9/2006 | Gleason, Jr. | 224/633 |
| 2007/0137959 | A1 | * | 6/2007 | Zauderer | 190/110 |
| 2007/0175941 | A1 | * | 8/2007 | Berry et al. | 224/583 |
| 2007/0228091 | A1 | | 10/2007 | Shawen | |

* cited by examiner

*Primary Examiner* — Brian D Nash
*Assistant Examiner* — Corey Skurdal
(74) *Attorney, Agent, or Firm* — Patents + TMS, P.C.

(57) ABSTRACT

A modular backpack has a harness, a container and/or a cover. The container is detachable from the harness for use without the harness. A different container is attachable to the harness to provide a different volume, different compartments and/or different ornamental features. A different cover is attachable to the container and/or the harness to provide different compartments and/or different ornamental features. Removable compartments may attach and detach from various locations on the backpack to customize the backpack.

1 Claim, 3 Drawing Sheets

MODULAR BACKPACK AND A METHOD FOR USING SAME

BACKGROUND OF THE INVENTION

The present invention generally relates to a modular backpack. In addition, the present invention relates to a backpack having a harness, a container and/or a cover. The container may be detached from the harness for use without the harness. A different container may be attached to the harness to provide a different volume, different compartments and/or different ornamental features. A different cover may be attached to the container and/or the harness to provide different compartments and/or different ornamental features. Removable compartments may attach and detach from various locations on the backpack to customize the backpack.

A backpack is often used to transport articles, such as, for example, a laptop computer, books, personal items, writing materials, toiletries, clothes, or any number of items. The articles are placed within the backpack interior or in compartments attached to the backpack. Traditional backpacks have two vertical shoulder straps, a diagonal shoulder strap or a small handle for carrying the backpack.

The interior of the traditional backpack has a fixed volume. The articles to be transported may have a volume which may not exceed the fixed volume of the backpack. If the volume of the articles is substantially the same as the fixed volume, the backpack is generally considered "filled", and additional articles cannot be placed within the backpack interior. Further, the articles to be transported may have a volume substantially smaller than the fixed volume of the backpack. As result, use of the backpack to transport the articles is cumbersome and/or inconvenient. For example, use of a large backpack to carry personal items may require more effort than merely carrying the personal items. The fixed volume of the backpack may be suitable for some situations but not suitable for other situations. For example, a backpack sized and shaped to accommodate gym shoes and clothing may not be ideal for transporting school books and school supplies to a class. Traditional backpacks have a fixed volume that cannot be changed for different uses.

Traditional backpacks have fixed, unmovable compartments that are integral with the backpack. The compartments of the backpack may be useful in some situations but not useful in other situations. For example, compartments sized and shaped for transport of pens and pencils are useful for transporting articles to school, but are not useful for traveling to the gym. A compartment for a media player may be desired in some circumstances but not desired in other circumstances. In addition, a compartment may be useful in one location on the backpack for one situation, such as, for example, making a media player readily accessible in a compartment on the backpack exterior. However, a compartment may be more useful in a different location for another situation, such as, for example, storing a wallet in a compartment in the backpack interior.

Moreover, traditional backpacks have ornamental features that cannot be changed. A user of a backpack may prefer different ornamental features of the backpack without purchasing a new backpack.

A need, therefore, exists for a modular backpack. Furthermore, a need exists for a backpack that may adapted for various uses. Finally, a need exists for a backpack that has a container and a cover that separate from the backpack harness.

SUMMARY OF THE INVENTION

The present invention generally relates to a modular backpack. In addition, the present invention relates to a backpack having a harness, a container and/or a cover. The container may be detached from the harness for use without the harness. A different container may be attached to the harness to provide a different volume, different compartments and/or different ornamental features. A different cover may be attached to the container and/or the harness to provide different compartments and/or different ornamental features. Removable compartments may attach and detach from various locations on the backpack to customize the backpack.

To this end, in an embodiment of the present invention, a modular backpack is provided. The modular backpack has a harness having a central portion wherein the central portion has a left side and a right side; a first strap attached to the harness wherein the first strap has a first end and a second end that define a length and further wherein the first end and the second end are connected to the central portion of the harness; a container having a front side, a back side, a left side, a right side, a top side and a bottom side that define an interior wherein the container has an opening to provide access to the interior; and connecting means that attaches the container to the harness wherein the front side of the container is attached adjacent to the central portion of the harness, the left side of the container is secured adjacent to the left side of the central portion of the harness and the right side of the container is secured adjacent to the right side of the central portion of the harness wherein the connecting means separates the container from the harness.

In an embodiment, the modular backpack has a cover attached to the container and extending from the top side of the container to the bottom side of the container wherein the cover detaches from the container.

In an embodiment, the modular backpack has a compartment attached to the first harness wherein the compartment has an interior accessible through an opening in the compartment.

In an embodiment, the modular backpack has a second strap having a first end and a second end defining a length of the second strap and further wherein the second strap is connected to the central portion of the harness.

In an embodiment, the modular backpack has a second strap having a first end and a second end defining a length of the second strap and further wherein the second strap is connected to the container.

In an embodiment, the modular backpack has a wallet attachable to and detachable from the harness and the interior of the container.

In an embodiment, the modular backpack has a compartment attached to the container wherein the compartment attaches and detaches from the first container.

In an embodiment, the modular backpack has a second container connected to the harness by the connecting means wherein the second container has an interior that is a different size relative to the interior of the container.

In an embodiment, the modular backpack has a second harness attached to the container by the connecting means wherein the second harness is a different size than the harness.

In another embodiment of the present invention, a system for transporting articles is provided. The system has a harness; a strap having a first end and a second end that define a length wherein the first end and the second end of are connected to the harness; a first connector attached to the harness; and a plurality of containers wherein each of the plurality of containers has a second connector and an opening wherein the opening provides access to an interior of the container and further wherein the interior of each of the plurality of containers is a different size wherein the first connectors attach to the second connectors to attach one of the plurality of containers to the harness.

In an embodiment, the system has a plurality of covers wherein each of the plurality of covers has a first side and a second side wherein the first side is located in a position opposite to the second side wherein each of the plurality of covers attach to and detach from each of the plurality of containers.

In an embodiment, the system has a wallet attachable to and detachable from each of the plurality of containers.

In an embodiment, the system has a plurality of harnesses wherein each of the plurality of harnesses is a different size and each of the plurality of harnesses is attachable to and detachable from each of the plurality of containers.

In an embodiment, the system has a plurality of compartments attachable to and detachable from each of the plurality of containers wherein each of the plurality of compartments has a connecting means to attach to and detach from each of the plurality of containers.

In another embodiment of the present invention, a method for using a modular backpack is provided. The method has the steps of providing a first harness wherein the first harness has a central portion and a first connector attached to the central portion of the first harness; attaching a strap to the central portion of the first harness wherein the strap has a first end and a second end defining a length of the strap and further wherein the first end and the second end attach to the first harness; providing a first container having an interior and an opening wherein the opening provides access to the interior and further wherein the first container has a second connector; connecting the first connector to the second connector wherein connecting the first connector to the second connector attaches the first container to the first harness; detaching the first container from the harness; and attaching a second container to the harness wherein the second container has an interior, an opening that provides access to the interior and a third connector and further wherein the second container attaches to the harness by connection of the first connector to the third connector.

In an embodiment, the method has the step of attaching a strap to the container wherein the strap has a first end and a second end defining a length of the strap and further wherein the first end and the second end attach to the container.

In an embodiment, the method has the step of attaching the first container to a second harness wherein the second harness has a strap that has a first end and a second end that define a length of the strap and further wherein the first end and the second end of the strap attach to the second harness.

In an embodiment, the method has the steps of selectively attaching and detaching a cover to the first wherein the cover has a first side and a second side wherein the second side is in a position opposite to the first side and further wherein the cover is attached to the first container with the first side of the cover adjacent to the container.

In an embodiment, the method has the steps of selectively attaching and detaching a compartment to a first location and a second location on the first container wherein the second location is different than the first location.

It is, therefore, an advantage of the present invention to provide a modular backpack.

A further advantage of the present invention is to provide a backpack having a container that detaches from the harness.

And, another advantage of the present invention is to provide a backpack having containers of different sizes.

Still further, an advantage of the present invention is to provide a backpack having a first container with compartments different than compartments of a second container.

Another advantage of the present invention is to provide a backpack having a cover that detaches from the harness and/or the container.

Yet another advantage of the present invention is to provide a backpack having a first cover with compartments different than compartments of a second cover.

A further advantage of the present invention is to provide a backpack having a first cover with ornamental features different than ornamental features of a second cover.

Yet another advantage of the present invention is to provide a backpack having a container that has a strap so that the container may be used without the backpack harness.

A still further advantage of the present invention is to provide a backpack having a container that has attachment means for connecting to the backpack harness.

Further, an advantage of the present invention is to provide a backpack having wheels and a method for collapsing a backpack wherein the backpack has pockets, pouches and/or compartments.

And, another advantage of the present invention is to provide a backpack having wheels and a method for collapsing a backpack wherein the backpack may be transformed from a collapsed position into an open position.

Further, an advantage of the present invention is to provide a backpack having a harness with compartments that allow the harness to transport articles without use of the container.

Still further, an advantage of the present invention is to provide a backpack having a container and a harness that detach and/or reattach quickly and/or easily.

Moreover, an advantage of the present invention is to provide a method of using a modular backpack.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a modular backpack. In addition, the present invention relates to a backpack having a harness, a container and/or a cover. The container may be detached from the harness for use without the harness. A different container may be attached to the harness to provide a different volume, different compartments and/or different ornamental features. A different cover may be attached to the container and/or the harness to provide different compartments and/or different ornamental features.

Figure 1:
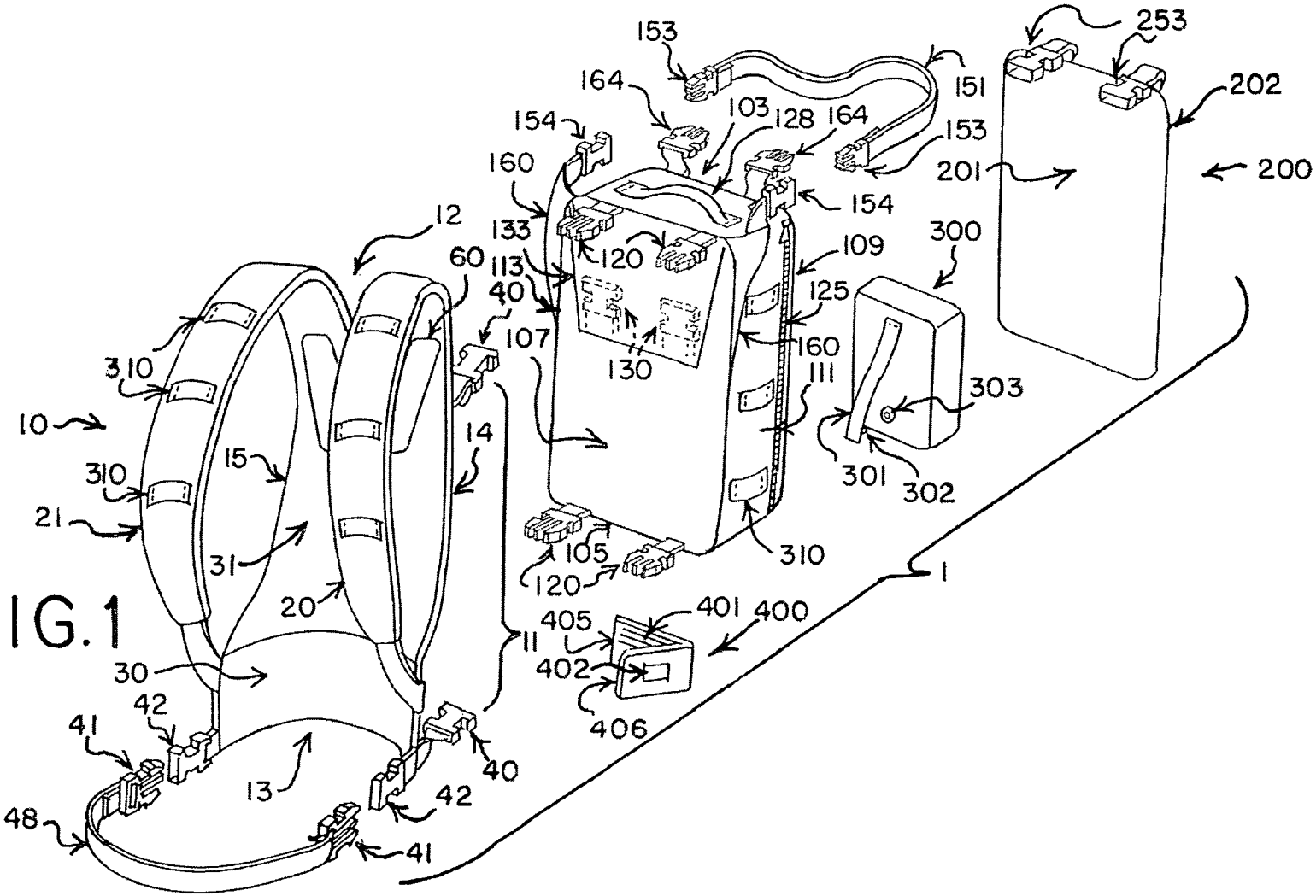
FIG. 1 illustrates a perspective view of an embodiment of a backpack of the present invention.
Figure 2:
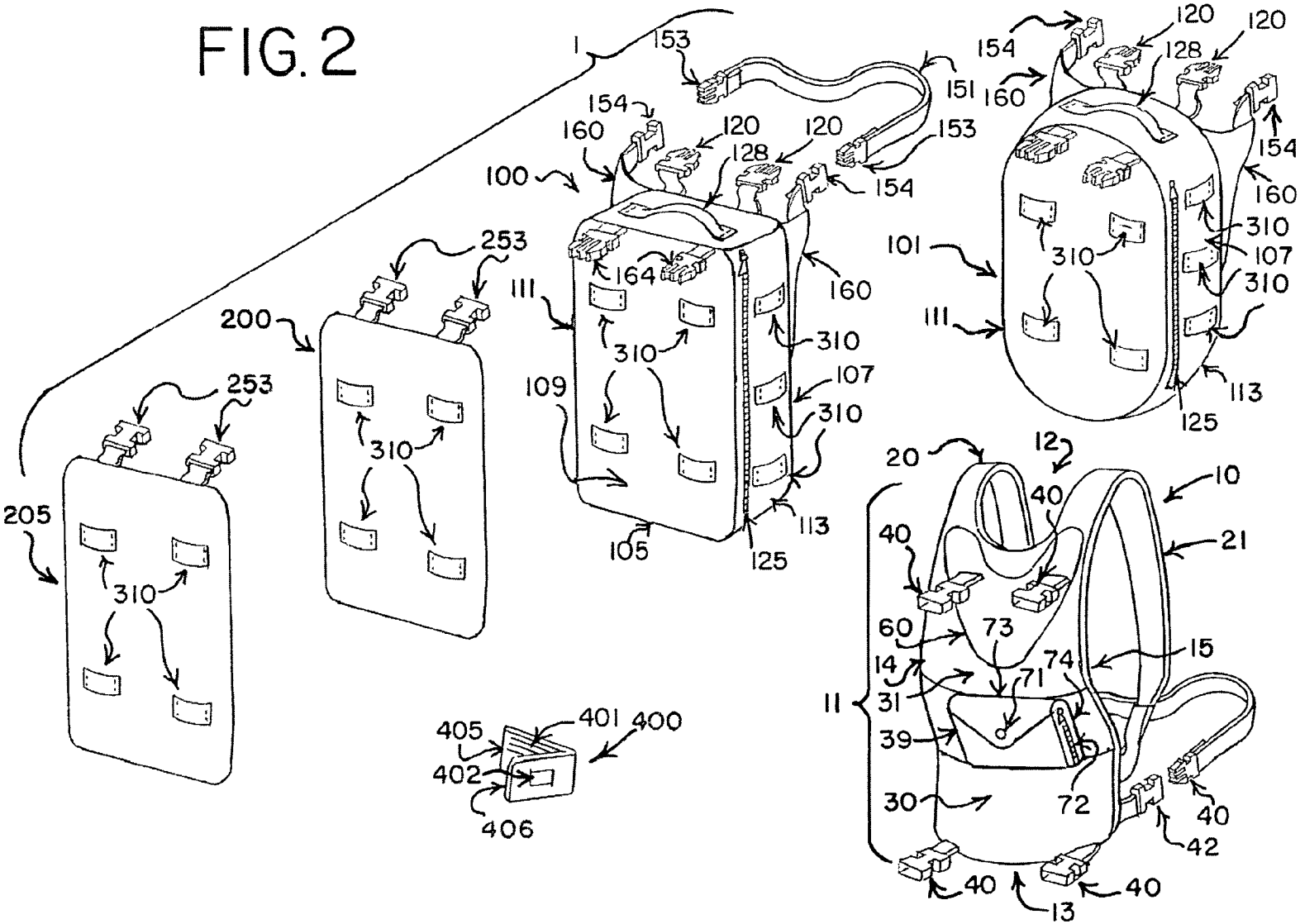
FIG. 2 illustrates a perspective view of an embodiment of the backpack of the present invention.

Referring now to the drawings wherein like numerals refer to like parts, FIGS. 1 and 2 illustrate a backpack 1. The backpack 1 may have a harness 10, a container 100 and/or a cover 200. The harness 10, the container 100 and/or the cover 200 may be manufactured from, for example, polyester, nylon, ballistic nylon, leather, canvas or the like.

The harness 10 may have a central portion 11, a first strap 20 and a second strap 21. The first strap 20 and/or the second strap 21 may extend from a top side 12 of the central portion 11. The first strap 20 and/or the second strap 21 may extend from a left side 14 and/or a right side 15 of the central portion 11, respectively. The first strap 20 and/or the second strap 21 may be made from, for example, polyester, nylon, ballistic nylon, leather, canvas or the like. Further, the central portion 11 of the harness 10 may be made from, for example, a mesh fabric that allows air to flow through the harness 10.

Arms of a user may be inserted between the first strap 20 and/or the second strap 21 and the harness 10 to carry the backpack 1. Further, the first strap 20 and/or the second strap 21 may be adjusted to fit the user. Furthermore, unattached portions of the first strap 20 and/or the second strap 21 may be, for example, padded to provide comfort while the backpack 1 and/or harness 10 is carried by the user.

The first strap 20 and/or the second strap 21 may extend from the left side 14 and/or the right side 15 instead of a bottom side 13 of the central portion 11 of the harness 10. If the first strap 20 and/or the second strap 21 do not extend from the bottom side 13 of the central portion 11 of the harness 10, the bottom side 13 of the central portion 11 of the harness 10 may not be pulled upward during use. Therefore, if the first strap 20 and/or the second strap 21 do not extend from the bottom side 13 of the central portion 11 of the harness 10, the backpack 1 may be comfortable for the user to wear and/or ergonomic.

The harness 10 may have a shape that maximizes surface area of the harness 10 and/or the backpack 1 that contacts the back of the user. As generally shown in FIGS. 1 and 2, the bottom side 13 of the harness 10 may curve outward relative to the back of the user to accommodate the curve of a torso and/or a waist of the user. The central portion 11 of the harness 10 may have a lower section 30 and an upper section 31. Since an upper back of the user usually extends outward relative to a lower back of the user, the upper section 31 and the lower section 31 are arranged in offset positions. The upper section 31 of the central portion 11 of the harness 10 may curve outward relative to the lower section 30 of the central portion 11 of the harness 10. Thus, during use, the upper section 31 of the central portion 11 of the harness 10 may contact the upper back of the user, and/or the lower section 30 of the central portion 11 of the harness 10 may contact the lower back of the user. Therefore, the harness 10 may ergonomically displace weight of the backpack 1 throughout the harness 10.

The harness 10 may have an upper support 60 that may be attached to the upper section 31 of the central portion 11 of the harness 10. The upper support 60 may be shaped to generally resemble a "V". The upper support 60 may be made from rigid material to provide structural support to the harness 10.

To carry the backpack 1 and/or the harness 10, the user may, for example, place a left arm between the first strap 20 and the harness 10 and/or a right arm between the first strap 20 and the harness 10. More specifically, the first strap 1 and/or the second strap 21 may be placed onto a left shoulder of the user and/or a right shoulder of the user, respectively. For additional support, the user may grasp the first strap 20 and/or the second strap 21 with his or her hand.

Figure 3:
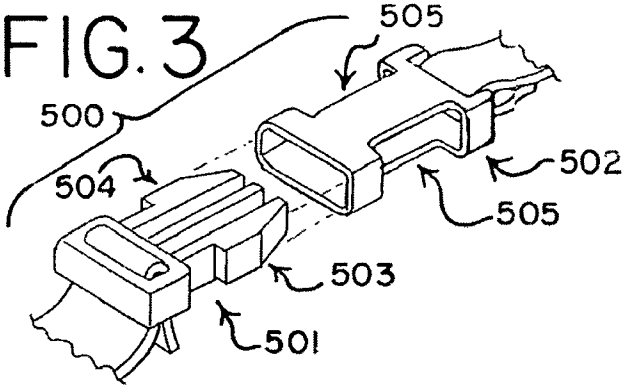
FIG. 3 illustrates a perspective view of a side release push buckle in an embodiment of the present invention.

Further, as generally shown in FIGS. 1 and 2, the harness 10 may have a third strap 48. The third strap 48 may have first connectors 41, and/or the harness 10 may have second connectors 42. The first connectors 41 may connect to the second connectors 42 to attach the third strap 48 to the harness 10. For example, the first connectors 41 and/or the second connectors 42 may form a male component 501 and/or a female component 502 of a side release push buckle 500, as generally shown in FIG. 3. The side release push buckle 500 may allow the user to detach the male component 501 from the female component 502 by pushing opposite sides 503, 504 of the male component 501 inward through openings 505 in the female component 502.

Detachment of the first connectors 41 from the second connectors 42 may detach the container 100 from the harness 10. Alternatively, the third strap 48 may attach to the harness 10 by any known connecting means, such as, for example, a hook and loop fastener, a zipper, a button and a hole, a snap or the like. Connection between the third strap 48 and the harness 10 is not limited to a specific embodiment. It should be understood that the harness 10 may be connected to the third strap 40 by any connecting means known to one having ordinary skill in the art.

Referring again to FIGS. 1 and 2, the harness 10 may have a harness compartment 39. The harness compartment 39 may have an interior 70 that may hold the articles. The harness compartment 39 may have a zipper 72 which may be unzipped and/or a snap 71 that may be unsnapped to allow access to the interior 70 of the harness compartment 39. For example, in a preferred embodiment, the harness compartment 39 may open on top 73 via the snap 71 and may open a side 74 via the zipper 72. The harness compartment 39 may allow the harness 10 to transport the articles without use of the container 100.

The harness 10 may be one of various sizes. For example, the harness 10 may have a size of "small", "medium", "large" or "extra large". An additional harness may be a different size. Therefore, the container 100 may be utilized by users of different heights and/or weights by connecting the harness 10 of an appropriate size.

The container 100 may have a top end 103, a bottom end 105, a front side 107, a back side 109, a left side 111 and a right side 113. The container 100 may be generally in the shape of, for example, a rectangle; however, the container 100 may be cubic, spherical or any other shape. The container 100 may have third connectors 120 on the front side 107 of the container 100. The third connectors 120 may be attached to the top end 103 and/or the bottom end 105 of the container 100.

The harness 10 may have fourth connectors 40 on the top side 12 and/or the bottom side 13 of the central portion 11 of the harness 10. The third connectors 120 may connect to the fourth connectors 40 to attach the container 100 to the harness 10. For example, the fourth connectors 40 and/or the third connectors 120 may form the male component 501 and/or the female component 502 of a side release push buckle 500, as generally shown in FIG. 3. The side release push buckle 500 may allow the user to detach the male component 501 from the female component 502 by pushing opposite sides 503, 504 of the male component 501 inward through openings 505 in the female component 502.

Detachment of the third connectors 120 from the fourth connectors 40 may detach the container 100 from the harness 10. Alternatively, the container 100 may attach to the harness 10 by any known connecting means, such as, for example, a hook and loop fastener, a zipper, a button and a hole, a snap or the like. Connection between the container 100 and the harness 10 is not limited to a specific embodiment. It should be understood that the harness 10 may be connected to the container 100 by any connecting means known to one having ordinary skill in the art.

The container 100 may have a zipper 125 which may be unzipped to allow access to an interior 127 of the container 100. The interior 127 of the container 100 may store articles, such as, for example, a laptop, school books, writing materials, toiletries, clothes, or any number of items. The zipper 125 may be located, for example, on the top end 103, the bottom end 105, the back end 109, the left side 111 and/or the right side 113 of the backpack 1. In a preferred embodiment, the zipper 125 may be located on the left side 111 and/or the right side 113 to enable the user to open the zipper 125 without removing the backpack 1.

The container 100 may also have a handle 128. The handle 128 may be used to, for example, carry the backpack 1 and/or the container 100 and/or hang the backpack 1 and/or the container 100 on a hook, for example, within a school locker and/or a gym locker. The handle 128 may be connected to the top end 3 of the backpack 1.

The container 100 may have a pocket 133. If the container 100 is detached from the harness 10, the third connectors 120 may be placed within the pocket 133. If the container 100 is detached from the harness 10, the container 100 may be used without the harness 10 to transport the articles, such as, for example, by the user holding the handle 128. The third connectors 120 may attach to fifth connectors 130 within the pocket 133. Attachment of the third connectors 120 to the fifth connectors 130 within the pocket 133 may prevent the third connectors 120 from hanging from the container 100 while the container is used without the harness 10.

A fourth strap 151 may connect to the top end 103 of the container 100. The fourth strap 151 may enable the container 100 to be used as a "messenger bag" without the harness 10. The fourth strap 151 may have sixth connectors 153, and/or the container 100 may have seventh connectors 154. The sixth connectors 153 may connect to the seventh connectors 154 to attach the fourth strap 151 to the container 100. For example, the sixth connectors 153 and/or the seventh connectors 154 may form the male component 501 and/or the female component 502 of the side release push buckle 500, as generally shown in FIG. 3. The side release push buckle 500 may allow the user to detach the male component 501 from the female component 502 by pushing opposite sides 503, 504 of the male component 501 inward through openings 505 in the female component 502.

The seventh connectors 154 may be attached to the container by flaps 160. The flaps 160 may fold against the front side 107 of the container 150 if the fourth strap 151 is not attached to the container 100. Detachment of the sixth connectors 153 from the seventh connectors 154 may detach the fourth strap 151 from the container 100. Alternatively, the fourth strap 151 may attach to the container 100 by any known connecting means, such as, for example, a hook and loop fastener, a zipper, a button and a hole, a snap or the like. Connection between the container 100 and the fourth strap 151 is not limited to a specific embodiment. It should be understood that the fourth strap 151 may be connected to the container 100 by any connecting means known to one having ordinary skill in the art.

As generally shown in FIGS. 1 and 2, the backpack 1 may have a wallet 400. The wallet 400 may have slots 401 for credit cards, paper currency, coins, receipts, photographs, identification cards and/or the like. The wallet 400 may connect to the interior 127 of the container 100 and/or the interior 70 of the harness compartment 39. For example, the wallet 400 may connect to the interior 127 of the container 100 and/or the interior 70 of the harness compartment 39 by an eighth connecting means 402, such as, for example, a hook and loop fastener, a snap or other like connecting means. The wallet 400 may fold to contact a left edge 405 of the wallet 400 with a right edge 406 of the wallet 400. Folding the wallet 400 may allow the wallet 400 to be carried in a pocket of the user if the wallet 400 is not connected to the interior 127 of the container 100 and/or the interior 70 of the harness compartment 39.

Figure 4:
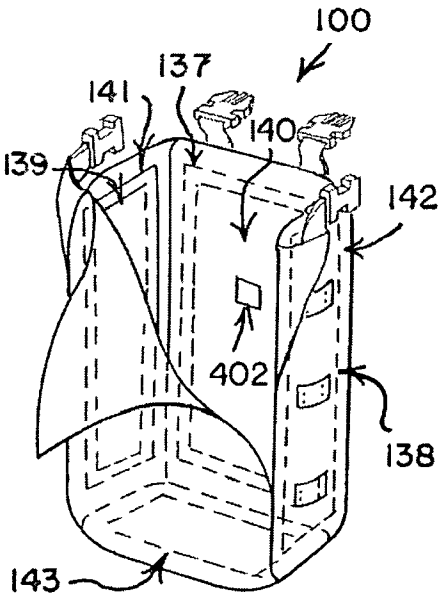
FIG. 4 illustrates a perspective view of an embodiment of a container of the backpack of the present invention.

As generally shown in FIG. 4, the container 100 may have a support frame 137 made from, for example, plastic, wood, metal, or the like. Further, the support frame 137 may support canvas, nylon or other outer material 102 of the container 100. The lining 140 may conceal the support frame 137. In addition, the lining 140 may prevent items from contacting the support frame 137. The support frame 137 may allow the container 100 to keep a fixed shape regardless of the articles within the container 100.

A lining 140 which may be made from, for example, polyester, nylon, ballistic nylon, leather, canvas or the like may be within the interior 127 of the container 100. The lining 140 may be generally in the same shape as, for example, the outer material 102 of the container 100. The lining 140 may protect the articles within the interior 127 of the container 100. Still further, the lining 140 may be removable for cleaning and/or replacement. More specifically, the lining 40 may be removably attached to the container 100 by, for example, a zipper, a hook and loop fastener, buttons, and/or the like (not shown).

The support frame 137 may have, for example, a left panel 138 and/or a right panel 139. The left panel 138 and/or the right panel 139 may be made from a rigid material. The left panel 138 and/or the right panel 139 may provide structural support to the container 100. A left opening 141 and/or a right opening 142 in the lining 140 may allow the left panel 138 and/or the right panel 139 to be removed, respectively. For example, removal of the left panel 138 and/or the right panel 139 may allow the container 100 to fold for storage.

The support frame 137 may further have a bottom panel 143. The bottom panel 143 may be made from, for example, plastic, metal or the like. The bottom panel 43 may be, for example, secured to the outer material 102 and/or the support frame 137 of the container 100 by, for example, rivets, screws, or the like. For example, during use of the container 100, the bottom panel 143 may be substantially perpendicular to the back side 109 and/or the front side 107 of the container 100 to support the articles placed within the interior 127 of the container 100. Further, the bottom panel 143 may be removable from the container 100.

The container 100 may detach from the harness 10 and a second container 101 may attach to the harness 10. The second container 101 may have a different size, a different shape, different ornamental features and/or different compartments relative to a previously attached container 100 that may allow customization of the container 100 of the backpack 1. For example, the second container 101 may be sized to carry a laptop computer. As a further example, for transporting groceries or laundry, the second container 101 may be larger than the previously attached container 100.

The cover 200 may be made from a flexible, water resistant material, such as, for example, tarpaulin. Tarpaulin is woven polyethylene or cloth, such as canvas or polyester coated with a plastic, such as latex or PVC. The cover may have ornamental features on a first side 201 and/or a second side 202 of the cover 200.

The cover 200 may connect to the top end 103 of the container 100. The cover 200 may have ninth connectors 253, and/or the container 100 may have tenth connectors 164. The ninth connectors 253 may connect to the tenth connectors 164 to attach the cover 200 to the container 100. For example, the ninth connectors 253 and/or the tenth connectors 164 may form the male component 501 and/or the female component 502 of the side release push buckle 500, as generally shown in FIG. 3. The side release push buckle 500 may allow the user to detach the male component 501 from the female component 502 by pushing opposite sides 503, 504 of the male component 501 inward through openings 505 in the female component 502.

Detachment of the ninth connectors 253 from the tenth connectors 164 may detach the cover 200 from the container 100. Alternatively, the cover 200 may attach to the container 100 by any known connecting means, such as, for example, a hook and loop fastener, a zipper, a button and a hole, a snap or the like. Connection between the container 100 and the cover 200 is not limited to a specific embodiment. It should be understood that the cover 200 may be connected to the container 100 by any connecting means known to one having ordinary skill in the art.

Removable compartments 300 may attach to the back side 109, the left side 111, the right side 113 and/or the interior 127 of the container 100. Further, the removable compartments 300 may attach to the harness 10, the second side 202 of the cover 200, the first strap 20 and/or the second strap 21. Each of the removable compartments 300 may have a strap 301 with a snap post 302. Each of the removable compartments 300 may have a snap receptacle 303. The back side 109, the left side 111, the right side 113 and the interior 127 of the container 100 may have loops 310. The harness 10, the first side of the cover 200, the first strap 20 and/or the second strap 21 may have the loops 310. The removable compartments 300 may attach to one of the loops 310 by inserting the strap 301 through one of the loops 310 and connecting the snap post 302 to the snap receptacle 303. Thus, the backpack 1 may be customized by attaching the removable compartments 300 to any of the loops 310 on the container 100, the harness 10 and/or the cover 200.

The cover 200 may be connected to the container 100 with the first side 201 of the cover 200 facing the back side 109 of the container 100. Thus, the ornamental features of the second side 202 and/or the removable compartments 300 that may be attached to the second side 202 may be exposed on the backpack 1. The cover 200 may be detached from the container 100 and may be reattached to the container 100 with the second side 202 of the cover 200 facing the back side 109 of the container 100. Thus, the ornamental features of the first side 201 and/or the removable compartments 300 that may be attached to the first side 201 may be exposed on the backpack 1. The cover 200 may detach from the container 100, and a second cover 205 may be attached to the container 100. The second cover 205 may have different ornamental features and/or different compartments relative to a previously attached cover 200 that may allow customization of the cover 200 of the backpack 1. For example, different covers 200, 205 may be, for example, a different color and/or may depict different scenes, animals, logos, such as, for example, band logos, sporting team logos, or the like. As a further example, the second cover 205 may have ornamental features that may illuminate and/or reflect that may be beneficial for certain uses of the backpack 1, such as, for example, bicycle riding. As a further example, the second cover 205 may have slots for pens and pencils, and the user may connect the second cover 205 to the container 100 for traveling to school.

Figure 5:
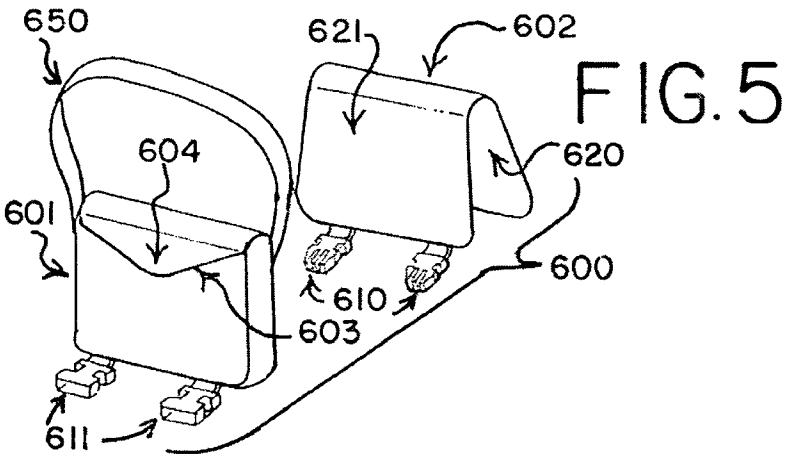
FIG. 5 illustrates a perspective view of an embodiment of a purse of the present invention.

As generally shown in FIG. 5, a purse 600 is provided in an embodiment of the present invention. The purse 600 may have a container 601, a cover 602 and/or a purse strap 650. The container 600 may have an opening 603 that provides access to an interior 604 of the purse 600. The cover 602 may connect to the container 601. The cover 602 may have eleventh connectors 610, and/or the container 601 may have twelfth connectors 611. The eleventh connectors 610 may connect to the twelfth connectors 611 to attach the cover 602 to the container 601. For example, the eleventh connectors 610 and/or the twelfth connectors 611 may form the male component 501 and/or the female component 502 of the side release push buckle 500, as generally shown in FIG. 3. The side release push buckle 500 may allow the user to detach the male component 501 from the female component 502 by pushing opposite sides 503, 504 of the male component 501 inward through openings 505 in the female component 502.

Detachment of the eleventh connectors 610 from the twelfth connectors 611 may detach the cover 602 from the container 601. Alternatively, the cover 602 may attach to the container 601 by any known connecting means, such as, for example, a hook and loop fastener, a zipper, a button and a hole, a snap or the like. Connection between the container 601 and the cover 602 is not limited to a specific embodiment. It should be understood that the cover 602 may be connected to the container 601 by any connecting means known to one having ordinary skill in the art.

The cover 602 may be connected to the container 601 with a first side 620 of the cover 602 that may face the container 601. Thus, ornamental features of a second side 621 of the cover 602 may be exposed on the purse 600. The cover 602 may be detached from the container 601 and may be reattached to the container 601 with the second side 202 of the cover 602 facing the container 601. Thus, the ornamental features of the first side 620 of the cover 602 may be exposed on the backpack 1. The cover 602 may detach from the container 601, and a second cover 690 may be attached to the container 601. The second cover 690 may have different ornamental features relative to a previously attached cover 602 that may allow customization of the cover 602 of the purse 600.

The purse strap 650 may be attached to the container 601. The purse strap 650 may be detached from the container 601 for use of the container 601 without the purse strap 650, such as, for example, for use of the container 601 as a "clutch bag".

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A modular backpack comprising:

a first harness having a central portion wherein the central portion has a left side, a right side, a top side and a bottom side;

a first strap attached to the first harness wherein the first strap has a first end and a second end that define a length and further wherein the first end and the second end are connected to the central portion of the first harness;

a first container having a front side, a back side, a left side, a right side, a top side and a bottom side that define an interior wherein the first container has an opening to provide access to the interior;

a first connector which extends from the top side of the central portion of the first harness wherein the first connector extends from a position adjacent to the left side of the central portion of the first harness;

a second connector which extends from the top side of the first container at a position adjacent to the left side of the first container;

a third connector which extends from the top side of the central portion of the first harness wherein the third connector extends from a position adjacent to the right side of the central portion of the first harness;

a fourth connector which extends from the top side of the first container at a position adjacent to the right side of the first container wherein the first connector connects to the second connector and the third connector connects to the fourth connector to secure the top side of the first container adjacent to the top side of the first harness and secure the front side of the first container adjacent to the central portion of the harness and further wherein the first connector disconnects from the second connector and the third connector disconnects from the fourth connector to separate the top side of the first container from the top side of the first harness and separate the front side of the first container from the central portion of the harness;

a cover having a top side and a bottom side wherein a fifth connector and a sixth connector extend from the top side of the cover and further wherein a seventh connector and an eighth connector extend from the top side of the first container wherein the fifth connector connects to the seventh connector and the sixth connector connects to the eighth connector to secure the top side of the cover adjacent to the top side of the first container and then the fifth connector disconnects from the seventh connector and the sixth connector disconnects from the eighth connector to separate the top side of the cover from the top side of the first container wherein the fifth connector connects to the eighth connector and the sixth connector connects to the seventh connector to secure the top side of the cover adjacent to the top side of the first container and then the fifth connector disconnects from the eighth connector and the sixth connector disconnects from the seventh connector to separate the top side of the cover from the top side of the first container;

a pocket integral with an exterior surface of the first container wherein the second connector and the fourth connector insert into the pocket and further wherein the pocket is separated from the interior of the first container by the front side of the first container; and a ninth connector and a tenth connector located within the pocket wherein the second connector inserts into the pocket to connect to the ninth connector and further wherein the fourth connector inserts into the pocket to connect to the tenth connector.

* * * * *